US011920474B2

(12) United States Patent
Ma et al.

(10) Patent No.: US 11,920,474 B2
(45) Date of Patent: Mar. 5, 2024

(54) PROTECTING TROLLEY AND CONSTRUCTION METHOD OF ROCK BURST PREWARNING PROTECTION SYSTEM IN NON-CONTACT TUNNEL CONSTRUCTION

(71) Applicants: CHINA RAILWAY 16TH BUREAU GROUP CO., LTD., Beijing (CN); CHINA RAILWAY 16TH BUREAU GROUP BEIJING JIANGONG MACHINERY CO., LTD., Beijing (CN)

(72) Inventors: Dong Ma, Beijing (CN); Wuxian Wang, Beijing (CN); Yi Sun, Beijing (CN); Qinghong Wu, Beijing (CN); Binhua Wu, Beijing (CN); Huaxuan Xu, Beijing (CN)

(73) Assignees: CHINA RAILWAY 16TH BUREAU GROUP CO., LTD., Beijing (CN); CHINA RAILWAY 16TH BUREAU GROUP BEIJING JIANGONG MACHINERY CO., LTD., Beijing (CN)

( * ) Notice: Subject to any disclaimer, the term of this patent is extended or adjusted under 35 U.S.C. 154(b) by 307 days.

(21) Appl. No.: 17/577,032

(22) Filed: Jan. 17, 2022

(65) Prior Publication Data

US 2022/0136391 A1 May 5, 2022

Related U.S. Application Data

(63) Continuation of application No. PCT/CN2020/123080, filed on Oct. 23, 2020.

(51) Int. Cl.
*E21F 17/18* (2006.01)
*E21D 11/18* (2006.01)

(52) U.S. Cl.
CPC ..... *E21F 17/18* (2013.01); *E21D 11/18* (2013.01)

(58) Field of Classification Search
CPC ..... E21F 17/18; E21F 11/00; E21D 11/18
See application file for complete search history.

(56) References Cited

FOREIGN PATENT DOCUMENTS

CN 106224007 A * 12/2016
CN 106246217 A * 12/2016
CN 109162733 A * 1/2019 ..... E21D 11/10
(Continued)

*Primary Examiner* — David J Bolduc

(57) ABSTRACT

Provided are a protecting trolley and a construction method of rock burst prewarning protection system in non-contact tunnel construction. The protecting trolley includes a framework, a walking assembly, a rockfall buffering assembly, a spraying assembly and a rock burst prewarning system. The rockfall buffering assembly includes an arch frame in a fixed connection with the framework and a protecting net fixed on the arch frame. The spraying assembly includes a track car in connection with the rockfall buffering assembly and a spraying hose fixed on the track car, and the spraying hose sprays towards the surrounding rock. The rock burst prewarning assembly includes a thermosensitive infrared sensor used for detecting the temperature of the surrounding rock and a highly sensitive laser sensor used for detecting the deformation of the surrounding rock.

14 Claims, 13 Drawing Sheets

(56) References Cited

FOREIGN PATENT DOCUMENTS

| | | | | | |
|---|---|---|---|---|---|
| CN | 110056394 | A | * | 7/2019 | ..... E21F 17/18 |
| CN | 111058890 | A | | 4/2020 | |
| CN | 111140265 | A | | 5/2020 | |
| CN | 111441809 | A | | 7/2020 | |
| CN | 111520192 | A | | 8/2020 | |
| CN | 111520193 | A | | 8/2020 | |
| JP | S62261008 | A | | 11/1987 | |

* cited by examiner

A

B

C

D

E

F

PROTECTING TROLLEY AND CONSTRUCTION METHOD OF ROCK BURST PREWARNING PROTECTION SYSTEM IN NON-CONTACT TUNNEL CONSTRUCTION

CROSS-REFERENCE TO RELATED APPLICATION

This application is a continuation of international application of PCT application No. PCT/CN2020/123080 filed on Oct. 23, 2020. The entirety of the above-mentioned patent application is hereby incorporated by reference herein and made a part of this specification.

TECHNICAL FIELD

The present application relates to a field of tunnel excavation and protection and in particular, relates to a protecting trolley and a construction method of rock burst prewarning protection system in non-contact tunnel construction.

BACKGROUND ART

A rock burst is a phenomenon that a rock mass is affected by excavation unloading, resulting in the redistribution of surrounding rock stress, causing the stress concentration and strain energy aggregation near the tunnel wall, and further leading to random fracture, ejection and throw of surrounding rock in space. And this phenomenon is especially prominent at a tunnel face, a tunnel roof and a tunnel spandrel of a deep tunnel.

The rock burst, as a geological hazard, can not only lead to equipment loss, engineering failure and project delay, but also threaten the life safety of construction technicians to a great extent due to the features such as suddenness, randomness and violence.

Therefore, in order to reduce the threat to the constructors and construction equipment in case of the rock burst, it is particularly important to design a protection system.

SUMMARY

In order to effectively guarantee the construction process and personnel safety, the present application provides a protecting trolley and a construction method of rock burst prewarning protection system in non-contact tunnel construction.

In order to provide an effective protection for working personnel, the present application provides a protecting trolley.

A protecting trolley provided in the present application adopts the following technical solution:

A protecting trolley includes a framework, a walking assembly, a rockfall buffering assembly, a spraying assembly and a rock burst prewarning system.

The walking assembly serves as a driving source for movement of the framework and is fixed on the bottom of the framework.

The rockfall buffering assembly includes an arch frame in a fixed connection with the framework and a protecting net fixed on the arch frame. There are at least two arch frames stretching across the framework. Two ends of the arch frame are disposed on two sides of the framework respectively. Two sides of the protecting net are connected to two arch frames respectively, and the protecting net naturally subsides or draws close in the direction towards the framework due to self-gravity.

The spraying assembly includes a track car in connection with the rockfall buffering assembly and a spraying hose fixed on the track car, and the spraying hose sprays towards the surrounding rock.

The rock burst prewarning assembly includes a thermosensitive infrared sensor used for detecting the temperature of the surrounding rock and a highly sensitive laser sensor used for detecting the deformation of the surrounding rock.

With the above technical solution, the rockfall buffering assembly in cooperation with the framework can receive the rockfall falling from the top of the tunnel in the tunnel excavating process. The rockfall can fall on the protecting net, which reduces the possibility of the large rockfall directly falling onto the ground through the obstruction of the protecting net. The small rockfall passes through the barrier of the protecting net and falls from the protecting net onto the ground, which reduces the kinetic energy of the small rockfall and protects the working personnel. An emergency refuge assembly can provide a temporary shelter for working personnel when a dangerous situation appears in the tunnel excavating process, which provides more time for rescue operation and protects the working personnel. The spraying assembly can spray on the excavated surrounding rock, which softens the hard surrounding rock with rock burst trend and reduces the brittleness of the surrounding rock, so as to reduce the internal stress of the surrounding rock inside the tunnel and decrease the intensity of stress burst, so that the risk of the rock burst can be effectively reduced. The walking assembly enables the protecting trolley walking with the tunnel excavation, which provides an effective protection with increase of the excavating depth. In addition, the setting of the thermosensitive infrared sensor and the highly sensitive laser sensor can also monitor the surrounding rock. When the temperature of the surrounding rock changes and the surrounding rock deforms, the monitor equipment connected with the thermosensitive infrared sensor and the highly sensitive laser sensor can display in time, which facilitates the monitor personnel reminding the construction personnel of alerting or dodging in time.

Preferably, each side of the receiving net is fixed between two sides of the protecting net. The receiving net is positioned on the side of the protecting net sinking or closing to the framework. There are two impact resistant nets, which are fixedly connected on two sides of the protecting net respectively. Each side of the receiving net is positioned between two sides of the corresponding impact resistant net. The receiving net and the impact resistant net are positioned on two surfaces of the protecting net respectively. And the impact resistant net and the receiving net are both abutted to the protecting net.

Preferably, each side of the impact resistant net is positioned between two sides of the protecting net.

Preferably, an emergency refuge assembly is also included. The emergency refuge assembly includes a protecting plate fixed on the framework, an oxygen supply device fixed on the protecting plate and a fixing component fixed on the protecting plate. The protecting plate is inverted L-shaped and forms a space for accommodating personnel together with the framework. The fixing component includes two fixing rods in a hinge joint with the protecting plate via damping hinge. And a space for the refugee head to pass through is reserved between the two fixing rods.

Preferably, an auxiliary supporting device is also included. The auxiliary supporting device includes a hydraulic cylinder fixed on the bottom of the framework and an abutting plate fixed on the end of the piston rod of the hydraulic cylinder. The abutting plate is disposed facing away from the framework.

In order to judge the rock burst position in advance, the present application also provides a rock burst prewarning protection system in non-contact tunnel construction.

1. The rockfall buffering assembly in cooperation with the framework can receive the rockfall falling from the top of the tunnel in the tunnel excavating process. The rockfall can fall on the protecting net, which reduces the possibility of the large rockfall directly falling onto the ground through the obstruction of the protecting net. The small rockfall passes through the barrier of the protecting net and falls from the protecting net onto the ground, which reduces the kinetic energy of the small rockfall and protects the working personnel. An emergency refuge assembly can provide a temporary shelter for working personnel when a dangerous situation appears in the tunnel excavating process, which provides more time for rescue operation and protects the working personnel.

2. In the process of rock burst simulation, the local temperature increase caused by crack propagation is much greater than that caused by ejection. That is, there is an acceleration peak of the temperature increase in the surrounding rock before rock burst. Thus, the corresponding deformation acceleration of the surrounding rock is the corresponding alarm maximum deformation acceleration. By capturing this rule, the rock burst trend can be prejudged, which form a so-called rock burst criterion. Since there is an energy accumulation process in the rock burst area, the temperature of the surrounding rock with the rock burst trend increases in this process. thermosensitive infrared sensor searches the local high temperature area to sift out the rock burst section. On this basis, the highly sensitive sensor further locks the area where displacement or deformation changes rapidly, so as to realize a highly effective and accuracy prejudge.

DETAILED DESCRIPTION

Embodiment 1

Figure 1:
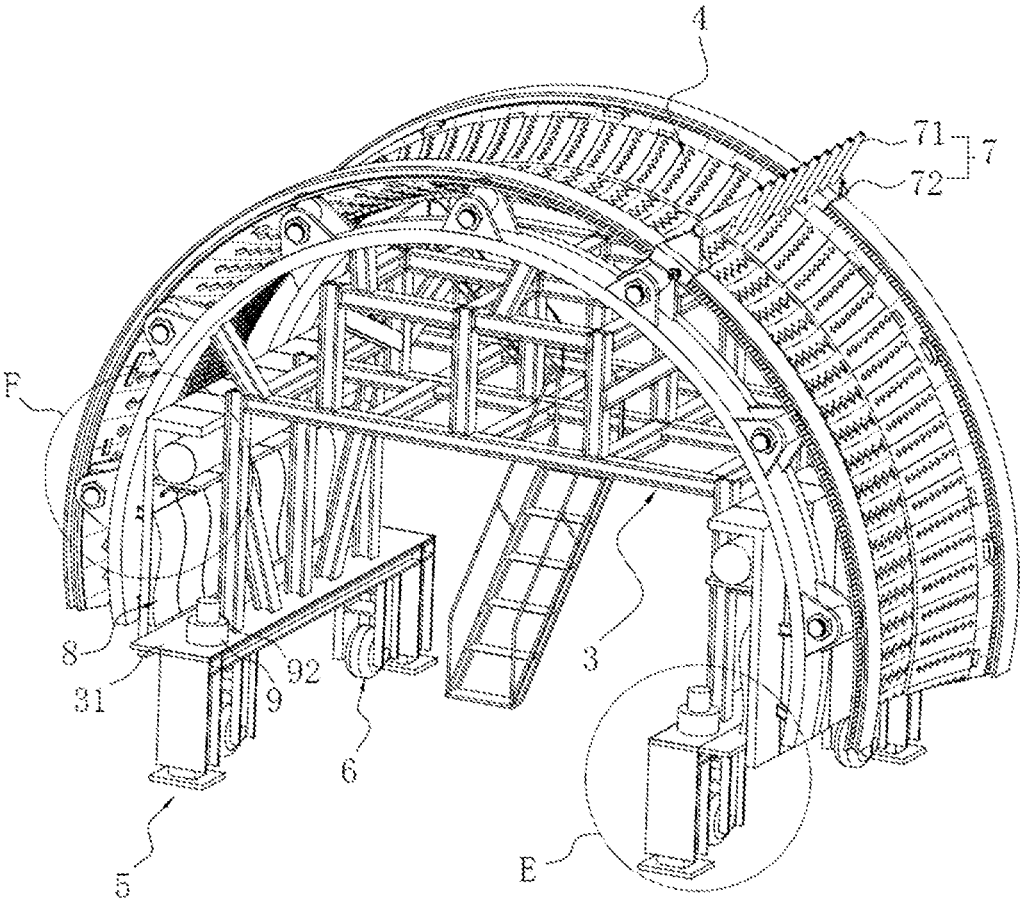
FIG. 1 is an axonometric diagram of Embodiment 1.

Referring to FIG. 1, a protecting trolley includes a framework 3. A horizontally disposed baseplate 31 is fixed on the bottom of the framework 3. A walking assembly 6 for driving the framework to move is fixed on the bottom of the baseplate 31. In this embodiment, the walking assembly 6 adopts solid rubber wheels driven by a stepper motor. There are four walking assemblies 6, which are distributed at four corners of a rectangle. A vertically disposed auxiliary supporting device 5 is fixed on the baseplate 31 on one side of the walking assembly 6. There is only one auxiliary supporting device 5 on one side of each walking assembly 6. Two sides of the framework 3 are both fixed with an emergency refuge assembly 8. An arch-shaped rockfall buffering assembly 4 is fixed on the top of the framework 3. Two ends of the rockfall buffering assembly 4 are positioned at two emergency refuge assembly 8 respectively.

The rockfall buffering assembly 4 is fixedly connected with a sliding track 74 with a corresponding contour. There are two sliding tracks 74, which are disposed on two sides of the rockfall buffering assembly 4 respectively. A spraying assembly 7 is in slidable connection on the sliding track 74 along the contour thereof. The spraying assembly 7 includes a track car 72 in a slidable connection with the rockfall buffering assembly 4 and a spraying hose 71 in a fixed connection with the track car 72. The spraying hose 71 is disposed facing away from the protecting net 2 and sprays towards the surrounding rocks.

Figure 2:
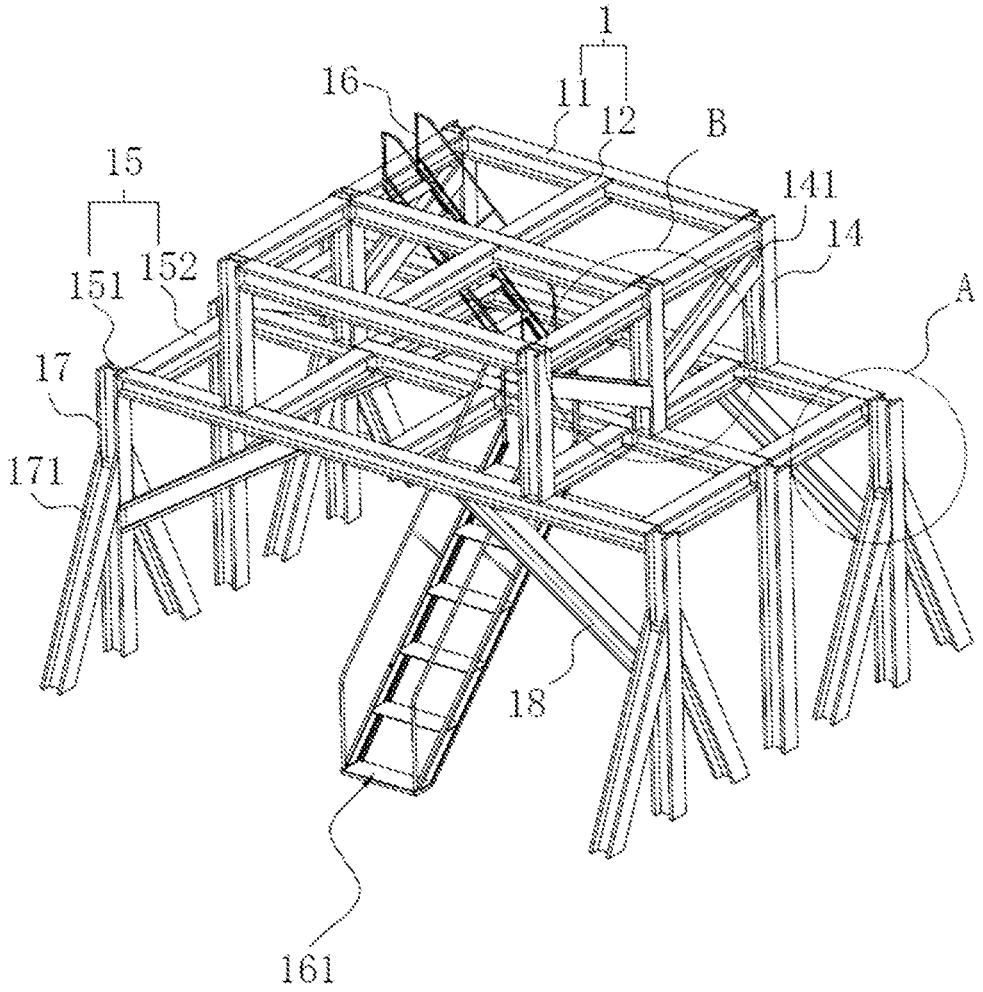
FIG. 2 is a schematic diagram for illustrating the framework structure in Embodiment 1.
Figure 3:
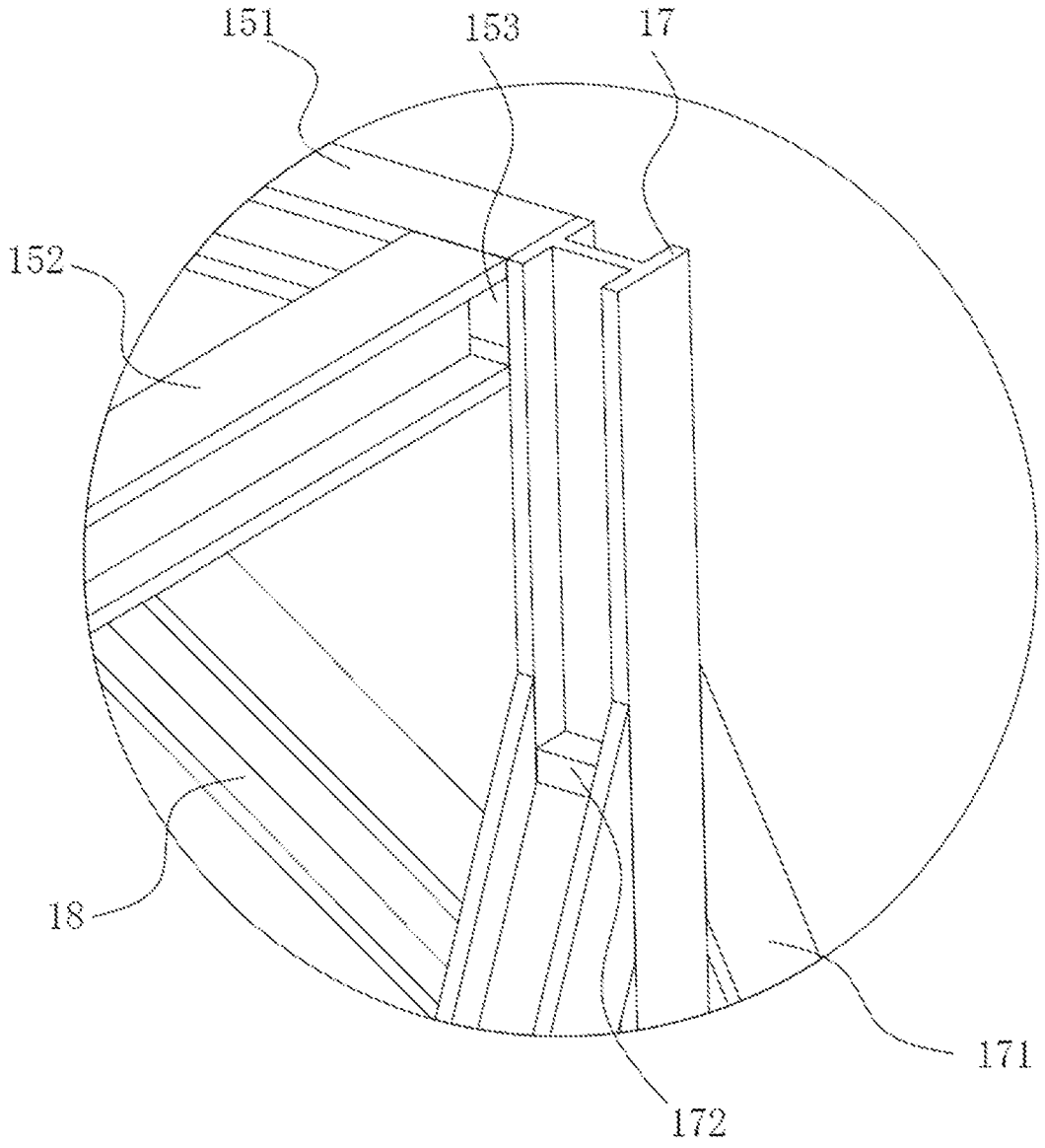
FIG. 3 is an enlarged view of Part A in FIG. 2 for illustrating the bottom vertical rod.

Referring to FIG. 2 and FIG. 3, the framework 3 includes six vertically disposed bottom vertical rods 17. The six bottom vertical rods 17 are arranged symmetrically in a group of three. The bottom vertical rod 17 is a vertically disposed I-beam. The six bottom vertical rods 17 are distributed on two corresponding sides of a rectangle. In a group of three bottom vertical rods 17, the bottom vertical rods 17 on two sides are both fixed with an inclinedly disposed bottom reinforcing rod 171. The bottom end of the bottom reinforcing rod 171 is flushed with the bottom end of the bottom vertical rod 17. Two bottom reinforcing rods 171 on the same bottom vertical rod 17 are arranged as a V shape with the opening downward. The I-shaped bottom vertical rod 17 is fixedly connected with a bottom reinforcing block 172 inside the groove in the position thereof connected with the bottom reinforcing rod 171. And the bottom reinforcing block 172 is fixed on one side of the bottom reinforcing rod 171.

An inclinedly disposed middle reinforcing rod 18 is in fixed connection on the sidewall of the bottom vertical rod 17. The sidewall of the bottom vertical rod 17 connected with the middle reinforcing rod 18 is perpendicular to the sidewall thereof connected with the bottom reinforcing rod 171. The bottom end of the middle reinforcing rod 18 is positioned between the top end of the bottom reinforcing rod 171 and the bottom vertical rod 17. A horizontally disposed middle connecting frame 15 is in fixed connection with the top end of the middle reinforcing rod 18. The middle connecting frame 15 includes a middle long rod 151 connected on the top of the bottom vertical rod 17 and a middle short rod 152 fixed between two adjacent middle long rods 151.

The middle connecting frame 15 and a top connecting frame 1 are both in a fixed connection with safety ladders. The extending directions of two safety ladders are disposed in an included angle. A top safety ladder 16 is connected with the top connecting frame 1, and a bottom safety ladder 161 is connected with the middle connecting frame 15. The top safety ladder 16 and the bottom safety ladder 161 are both connected to the protecting trolley through bolts. Since the safety ladder and the protecting trolley is in a detachably bolt connection, the quantity of the safety ladder and the mounting position can be changed according to working condition, for example, mounting the safety ladder to the side.

Figure 4:
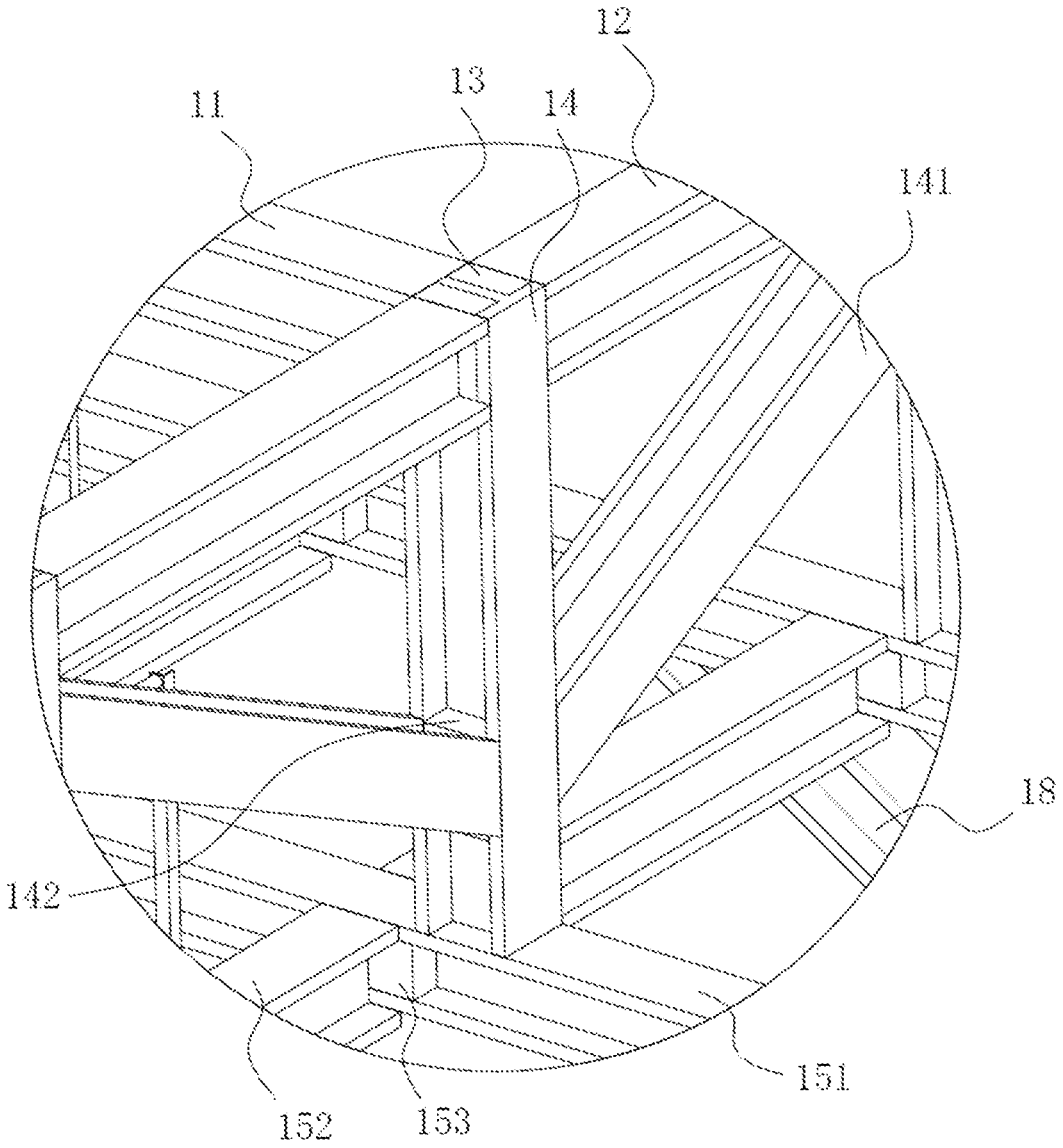
FIG. 4 is an enlarged view of Part B in FIG. 2 for illustrating the top vertical rod.

Referring to FIG. 3 and FIG. 4, there are three middle long rods 151, and each end of the middle long rod 151 is fixed on the top of one bottom vertical rod 17. There are ten middle short rods 152, which are uniformly distributed between two gaps formed by three middle long rods 151, so as to form a net frame structure. The middle long rod 151 is I-shaped, and the middle long rod 151 is fixedly connected with a middle connecting block 153 inside the groove in the position thereof connected with the middle short rod 152. The middle connecting block 153 is in a fixed connection with the middle short rod 152.

A vertically disposed top vertical rod 14 is fixed on the top surface of the middle connecting frame 15. The bottom end of the top vertical rod 14 is fixed on the top surface of the middle long rod 151. The bottom ends of the top vertical rod 14 and the connecting points of the middle connecting frame 15 are in staggered distribution. That is, the position of the middle long rod 151 connected with the middle short rod 152 and the position of the middle long rod 151 connected with the top vertical rod 14 are in staggered distribution. A horizontally disposed top connecting frame 1 is fixed on the top. The top connecting frame 1 includes a top long rod 11 fixed with the top vertical rod 14 and a top short rod 12 fixed with the top vertical rod 12. There are six top vertical rods 14, which are arranged in a group of three uniformly and symmetrically on three middle long rods 151. There are three top long rods 11, and each end of the top long rod 11 is fixed on the top end of one top vertical rod 14. The top vertical rod 11 is parallel to the middle long rod 151. There are six top short rods 12, which are uniformly distributed between two gaps formed by three top long rods 11, the top short rod 12 is parallel to the middle short rod 152 and the top connecting rod is perpendicular to the top short rod 12, so as to form a net frame structure. The projection of the top long rod 11 in the vertical direction is on the middle long rod 151. The top vertical rod 14 and the top short rod 12 are both I-shaped. The top vertical rod 14 is in a fixed connection with a top connecting block 13 inside the groove in the position connected with the top short rod 12. The top connecting block 13 and the top short rod 12 are in a fixed connection.

In a group of three top vertical rods 14, the top vertical rod 14 in the middle is fixed with an inclinedly disposed top reinforcing rod 141. The bottom end of the top reinforcing rod 141 is fixed on the middle top vertical rods 14 of the three top vertical rods 14 in one group, and the top end is fixed on another top vertical rod 14 besides this top vertical rod 14. Two top reinforcing rods 141 on the same top vertical rod 14 is arranged as a V shape with the opening upward.

Figure 5:
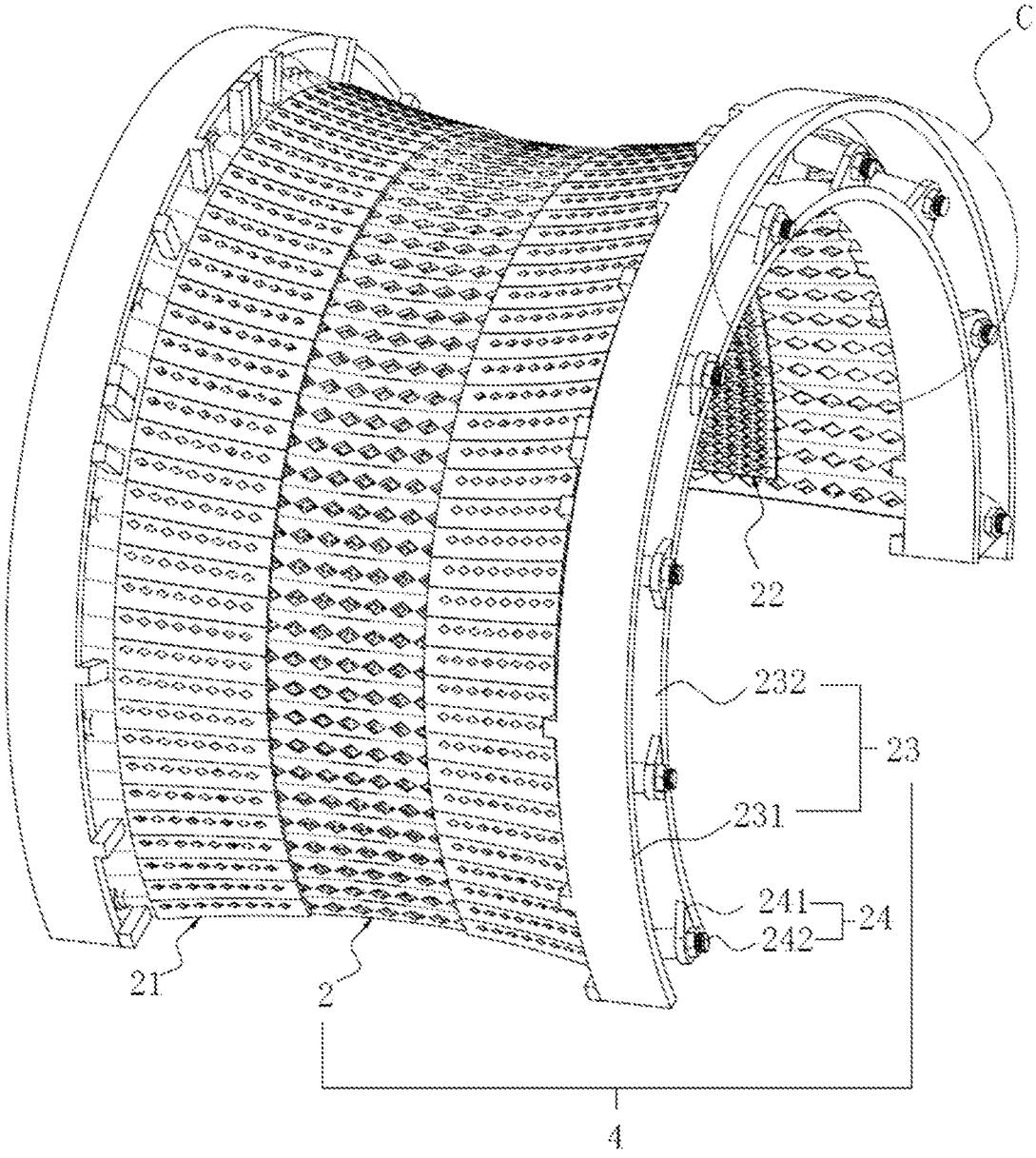
FIG. 5 is a schematic diagram of Embodiment 1 for illustrating the structure of the protecting net.
Figure 6:
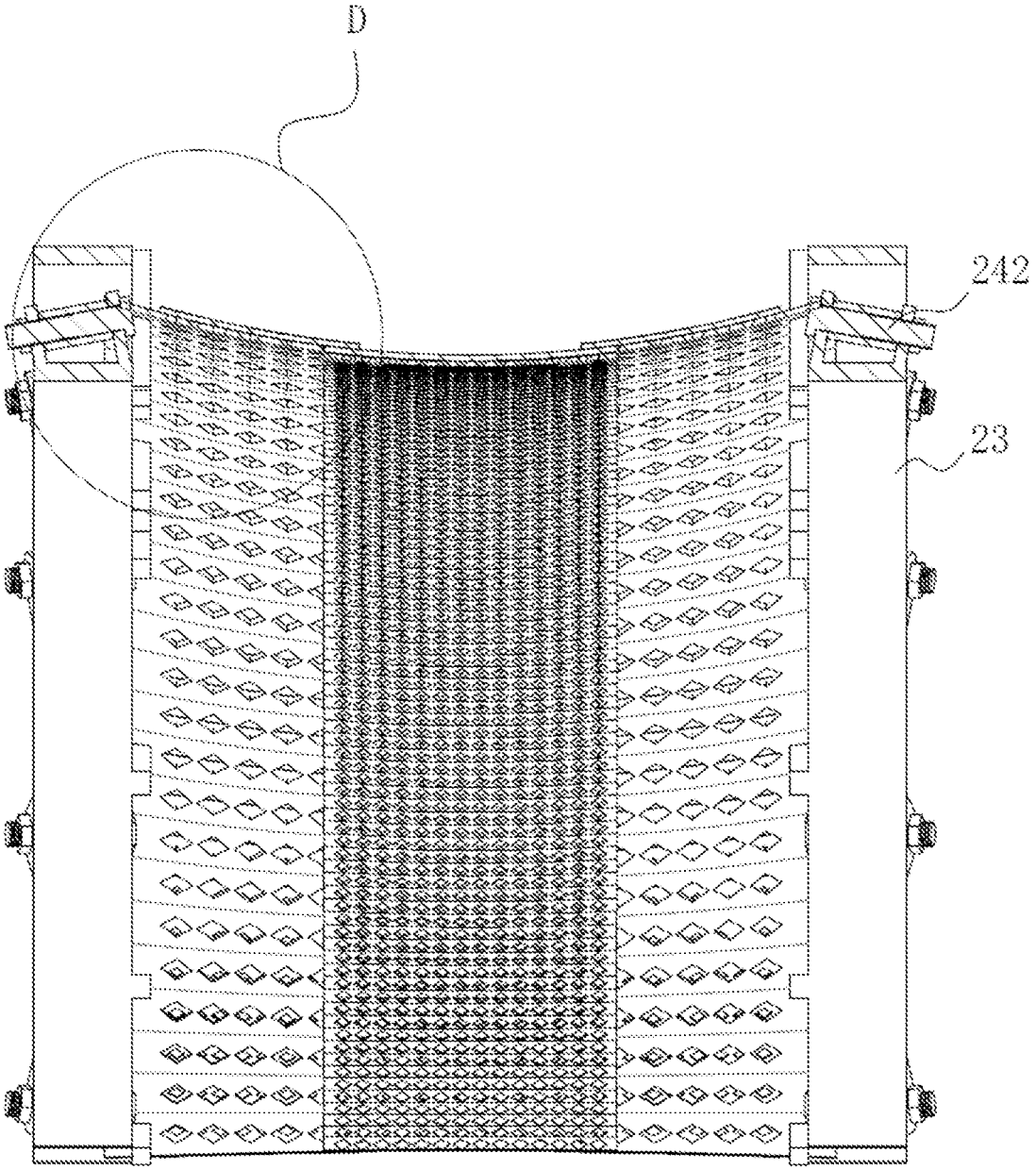
FIG. 6 is a schematic diagram of Embodiment 1 for illustrating the structure of the arch frame.

Referring to FIG. 5 and FIG. 6, the rockfall buffering assembly 4 includes a pair of arch frames 23 and a protecting net 2 positioned on the arch frame 23. The arch frame 23 is fixed with a fixer 24 for connecting the rock burst protecting trolley protecting net. The fixer 24 includes a supporting plate 241 fixed on the arch frame 23 and a high strength bolt 242 in a bolt connection with the supporting plate 241.

Figure 7:
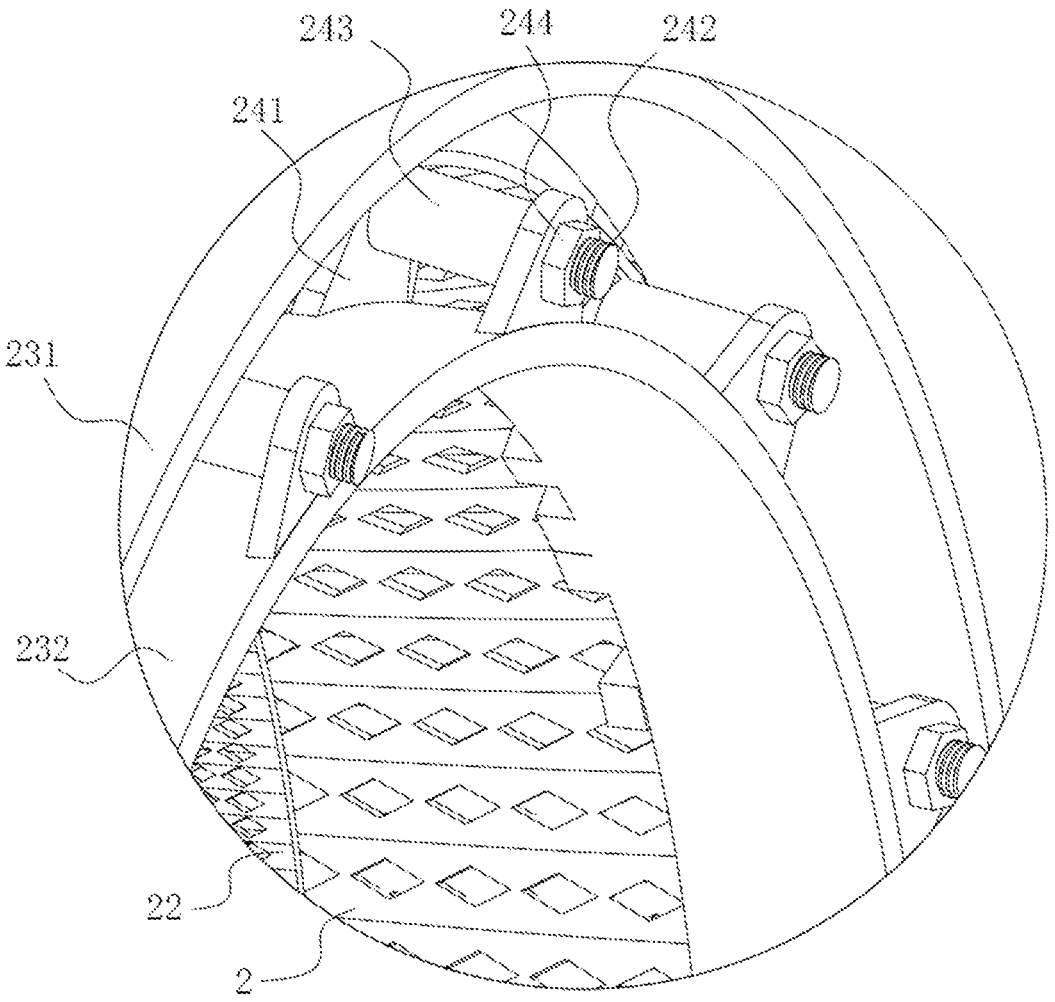
FIG. 7 is an enlarged view of Part C in FIG. 5 for illustrating the structure the supporting plate.
Figure 8:
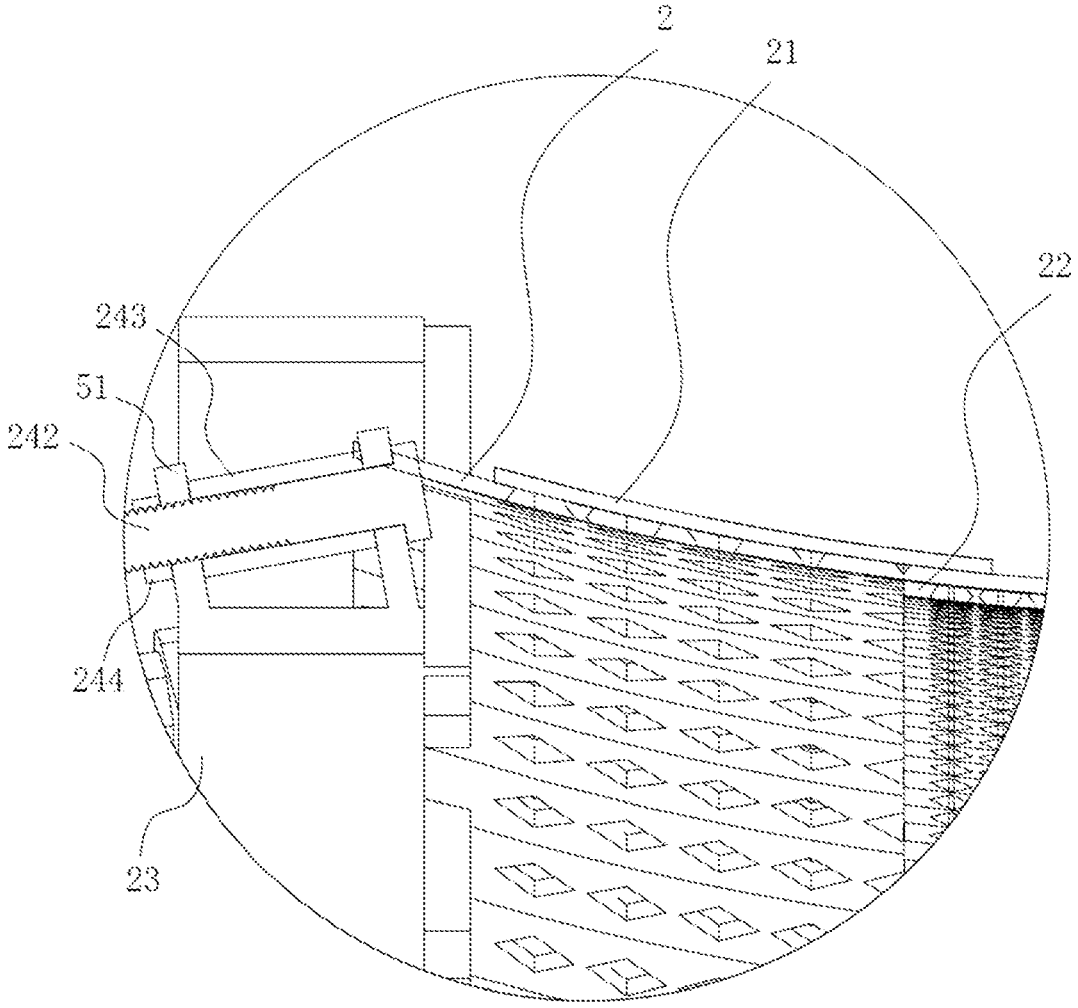
FIG. 8 is an enlarged view of Part D in FIG. 6 for illustrating the structure of the impact resistant plate.

Referring to FIG. 7 and FIG. 8, the high strength bolt 242 is inclinedly disposed. The head of the high strength bolt 242 is higher than the threaded tail thereof. The threaded tails of the high strength bolts 242 on two arch frame 23 are departing from each other. And the threaded tail of the high strength bolt 242 is threadedly connected with a nut 244. There are two supporting plate 241 between the high strength bolt 242 and the threadedly connected nut 244. The high strength bolt 242 between two supporting plates 241 is sleeved with a tubular wear resistant sleeve 243. Two ends of the wear resistant sleeve 243 are abutted on two supporting plates 241 respectively. The arch protecting net 2 is sleeved on the wear resistant sleeve 243. Two sides of the protecting net 2 are connected to the wear resistant sleeves 243 on two arch frame 23 respectively. The top and bottom surfaces of the protecting net 2 are both curved surfaces. The arch protecting net 2 protrudes to the inside of the surrounding area thereof to form an inner recess. The protecting net 2 is bound with a receiving net 22. Each side of the receiving net 22 is positioned between two sides of the protecting net 2. The center line of the receiving net 22 along the length direction thereof is positioned at the inner recess with the maximal curvature. The receiving net 22 is positioned on the side of the protecting net 2 inside the surrounding area thereof. Two sides of the protecting net 2 are both bound with an impact resistant net 21. Each side of the receiving net 22 is positioned between two sides of the corresponding impact resistant net 21. Each side of the impact resistant net 21 is positioned between two sides of the protecting net 2. Two sides of the receiving net 22 are bound with two sides of the impact resistant net 21 respectively. The corresponding side of two impact resistant net 21 is bound with the receiving net 22. The receiving net 22 and the impact resistant net 21 are on two surfaces of the protecting net 2 respectively. The impact resistant net 21 and the receiving net 22 are both abutted to the protecting net 2.

Figure 9:
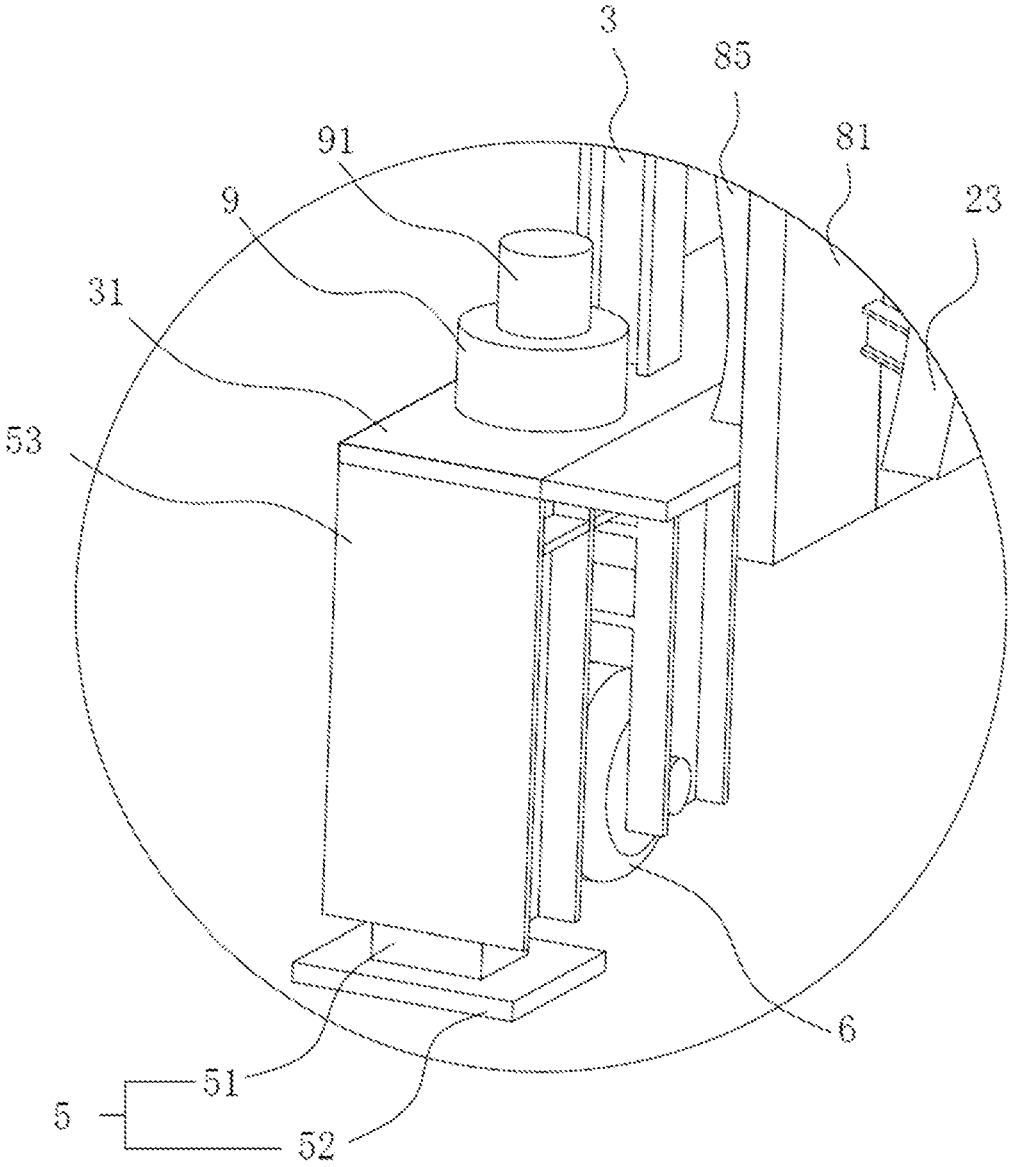
FIG. 9 is an enlarged view of Part E in FIG. 1 for illustrating the position of the walking assembly.

Referring to FIG. 9, the auxiliary supporting device 5 includes a hydraulic cylinder 51 fixed on the baseplate 31 and an abutting plate 52 fixed on the end of the piston rod of the hydraulic cylinder 51. The hydraulic cylinder 51 is vertically and downwards disposed. The abutting plate 52 is horizontally disposed. The end of the piston rod of the hydraulic cylinder 51 is fixed on the middle position of the abutting plate 52. The cylinder block of the hydraulic cylinder 51 is fixed with a vertically disposed sheltering plate 53. The sheltering plate 53 shelters the auxiliary supporting device 5 and walking assembly 6 in the moving direction of the framework 3.

Figure 10:
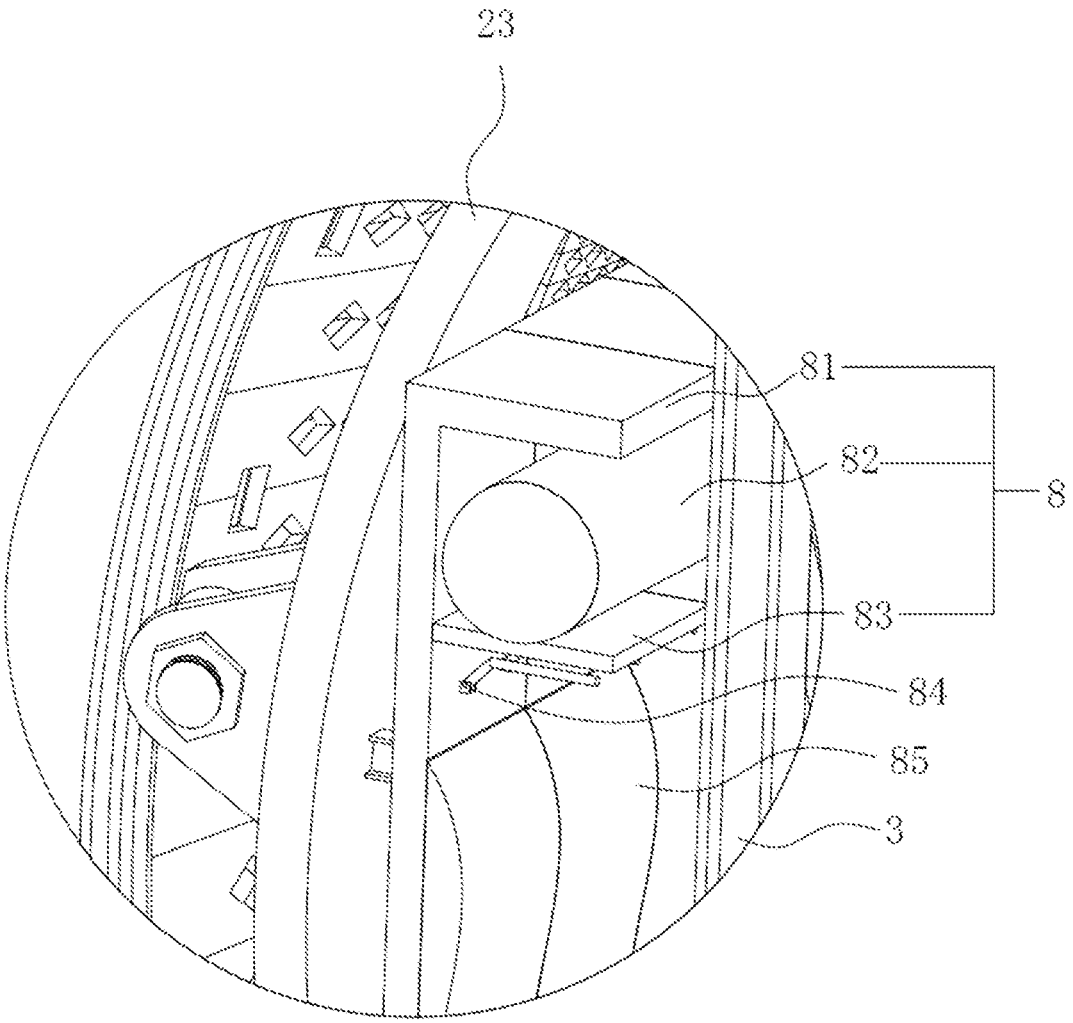
FIG. 10 is an enlarged view of Part F in FIG. 1 for illustrating the structure of emergency refuge assembly.

Referring to FIG. 9 and FIG. 10, the baseplate is with a rock burst prewarning system. the rock burst prewarning system includes a thermosensitive infrared sensor 91 used for detecting the surrounding rock and a highly sensitive laser sensor 92 used for detecting the surrounding rock. A plurality of rotating platforms 9 are fixed on the baseplate 31. There are two rotating platforms in this embodiment, which are positioned on two sides of the baseplate 31 respectively. The thermosensitive infrared sensor 91 and the highly sensitively sensor 92 are fixed on two rotating platforms 9 respectively. In other embodiments, the rotating platform 9 can be mounted on the framework 1 or arch frame 23 as well.

The emergency refuge assembly 8 includes a protecting plate 81 fixed on the framework 3, an oxygen supply device 82 fixed on the protecting plate 81 and a fixing component in a hinge joint with the protecting plate 81. The fixing component in this embodiment is a fixing rod 83 in the hinge joint with the protecting plate 81. The fixing rod 83 is bent into a rod shape with two parts arranged at an obtuse angle. The protecting plate 81 is inverted L-shaped. The oxygen supply device 82 is positioned on the top end of the bending area of protecting plate 81. A soft cushion 85 is fixed on the sidewall of the protecting plate 81 inside the bending area. The fixing rod 83 is positioned in the bending area of the protecting plate 81 above the soft cushion 85. The fixing rod 83 is positioned under the oxygen supply device 82. A buffering device is disposed between the fixing rod 83 and the protecting plate 81. The buffering device adopts hydraulic hinge 84 in this embodiment. The fixing rod 83 is connected with the protecting plate 81 via the hydraulic hinge 84. A space for the refugee head to pass through is reserved between the two adjacent fixing rods 83. When in use, the refugee back rests on the soft cushion 85, and the fixing rod 83 is pulled towards the refugee body, so that the head can pass the area between two fixing rods 83, and two fixing rods 83 are abutted on two shoulders. The rotation of the fixing rod 83 is blocked by the hydraulic hinge 84, so as to realize fixing the refugee body.

Figure 11:
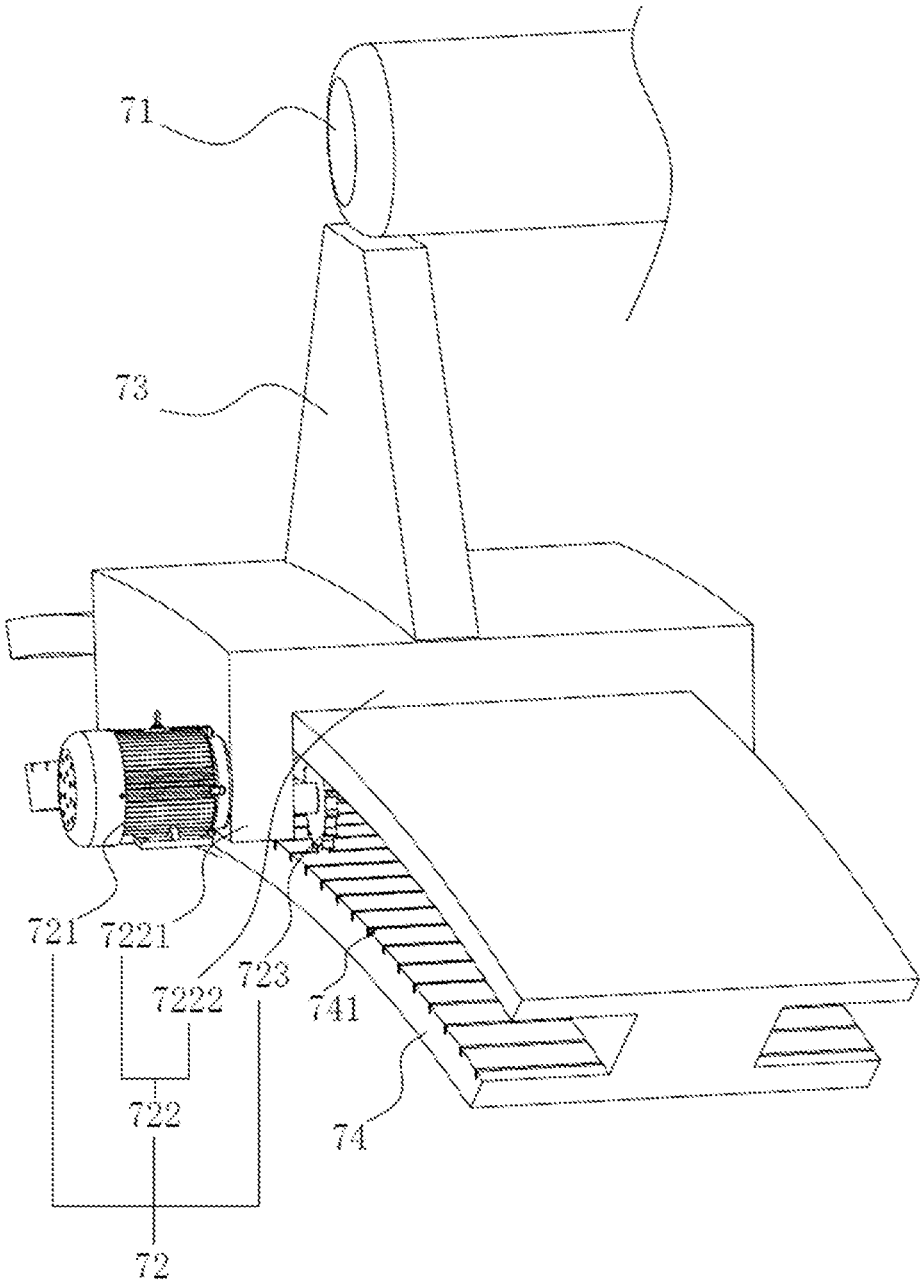
FIG. 11 is a schematic diagram of Embodiment 1 for illustrating the structure of the spraying assembly.

Referring to FIG. 11, there are two track cars 72, which are positioned on two sliding tracks 74 respectively. One sidewall of the sliding track 74 is provided with a sliding groove 741 adapted to the contour of the track car 72. The track car 72 includes a limiting plate 722, an electrical motor 721 fixed on the limiting plate 722 and toothed moving wheel 723 coaxially fixed on the output axle of the electrical motor 721. The limiting plate 722 is bent as C-shaped, i.e., the limiting plate 722 includes a main body 7222 adapted to the sliding track 74 and two flanks abutted to two sidewalls of the sliding track 74 respectively. The main body is abutted to the top surface of the sliding track. The shell of the electrical motor 721 is fixed with one flank 7221, and the output axle of the electrical motor 721 penetrates through one flank 7221 into the sliding groove 741. The toothed moving wheel 723 is also positioned in the sliding groove 741.

The inner bottom surface of the sliding groove 741 is provided with a clamping groove adapted to the gear teeth on the toothed moving wheel 723. The toothed moving wheel 723 is meshed with this clamping groove for positioning the gear teeth on the toothed moving wheel 723. The toothed moving wheel 723 is also abutted to the top surface of the sliding groove 741. In addition, since the electrical motor in this embodiment adopts an electrical motor 721 with self-locking function, cooperated with the limiting plate 722 abutted to the sliding groove 741, the above technical solution can keep the track car 72 stably stay in one position.

Embodiment 2

Figure 12:
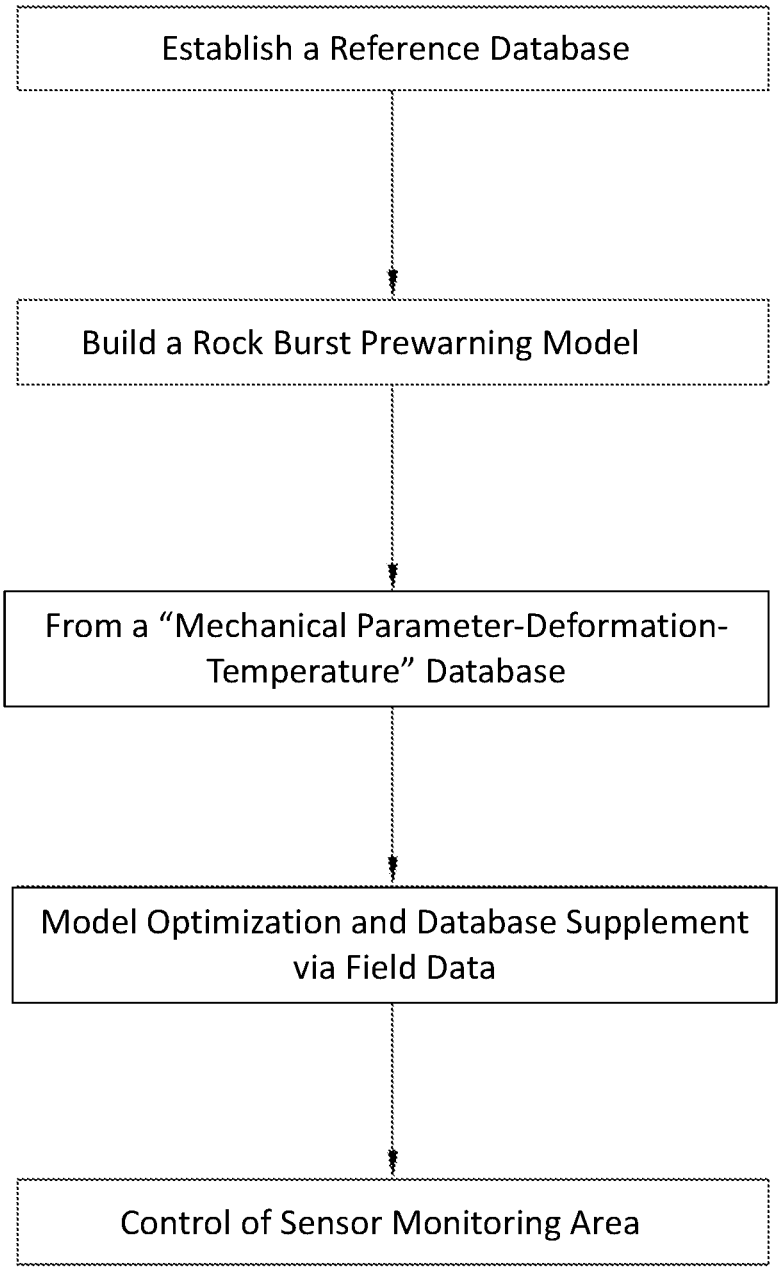
FIG. 12 is a flowchart for illustrating steps of Embodiment 2.
Figure 13:
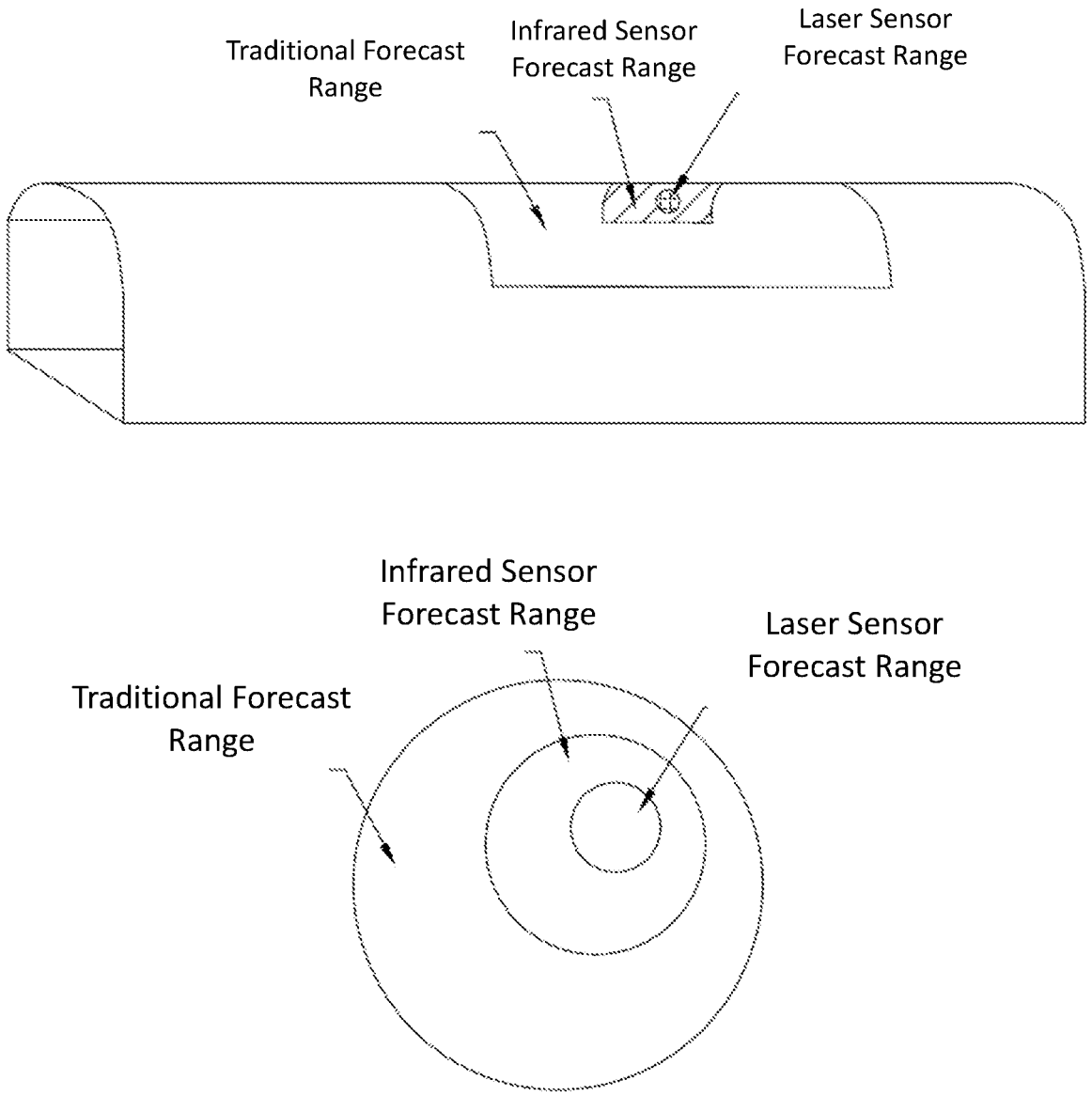
FIG. 13 is a schematic diagram for illustrating the acquired data range comparison of the thermosensitive sensor and the highly sensitive laser sensor.

A construction method of rock burst prewarning protection system in non-contact tunnel construction, referring to FIG. 12 and FIG. 13, includes the following steps:

I. collecting the traditional microseismic monitoring and geological prospecting data in the process of the existing tunnel excavation, determining the positions with high rock burst frequency of different types of surrounding rock in different regions, and establishing a reference database.

II. Taking the physicochemical indexes and the mechanical parameters of the surrounding rock as standard, and recording into the reference database; collecting the temperature change acceleration of the surrounding rock on site and the acceleration data of the surrounding rock deformation during the existing rock burst, comparing and learning the temperature change acceleration and deformation change acceleration of surrounding rock with similar physicochemical indexes and mechanical parameters in the rock burst stage under same or similar environmental parameters via artificial intelligence learning, summarizing the rules of the temperature change and the deformation change of different surrounding rocks with same or similar physicochemical indexes in the rock burst, summarizing the rules of the temperature change and the deformation change of different surrounding rocks with same or similar mechanical parameters in the rock burst, classifying and regulating the data collected in the previous steps via artificial neural network algorithm, in addition, increasing the environment parameters such as environment temperature, environment humidity, altitude and the size of the tunnel excavating face, classifying and regulating the rules of the temperature change and deformation change of the surrounding rocks according to the surrounding rock types, environment temperatures, environment humidity, altitudes and the sizes of the tunnel excavating face respectively; after introducing the cost matrix to eliminate or weaken the adverse effects caused by the imbalance of sample categories, constructing a neural network model, obtaining a tunnel rock burst prewarning model based on the reference database in Step I and the neural network model, inputting the multiparameter information in the area to be prewarned or the prewarning unit in the existing data into the established rock burst prewarning model, outputting the potential rock burst grade and the probability in the prewarning area via the calculation of the prewarning model, which can be used for referring and judging the model completeness by working personnel.

III. Obtaining the rock core in the area to be excavated via advanced geological drilling, conducting the isothermal triaxial test in the laboratory, determining the temperature change acceleration in the local temperature rapid rise stage of the surrounding rock during the rock burst foreshadow, testing and recording the temperature change acceleration when the local temperature of the surrounding rock rises during the rock burst foreshadow, inputting the above two variations into the reference data as reference; integrating the data of different temperature changes or deformation variables in the same stage of the same type of surrounding rock, taking the maximum and minimum values as the final reference, classifying the selected data from the same type of the surrounding rock according to the rock burst intensity on the base of the reference database established in Step I, which includes no rock burst, slight rock burst, moderate rock burst and strong rock burst, improving and forming a "surrounding rock mechanical parameter-rock burst critical deformation-rock burst critical temperature" database; comparing and analyzing each rock burst data with new variables via artificial intelligence learning in Step II, and inputting to the "surrounding rock mechanical parameter-rock burst critical deformation-rock burst critical temperature" database and the rock burst prewarning model via artificial neural network algorithm in Step II; the neural network in this embodiment includes 1 input layer, 2 convolutional layers, 2 pooling layers, 2 full-connected layers, 1 Softmax layer and 1 decision layer; the input layer inputs multi parameter sequence, the decision layer outputs the rock burst grade and probability thereof; training and optimizing the constructed rock burst prewarning model using the "surrounding rock mechanical parameter-rock burst critical deformation-rock burst critical temperature" database, randomly selecting 80% of the data as training samples and selecting he remaining 20% of the samples as test samples for training optimization, obtaining the model parameters with the highest classification accuracy of rock burst grade according to the classification results of test samples, that is, obtaining the rock burst prewarning model based on the "surrounding rock mechanical parameter-rock burst critical deformation-rock burst critical temperature" database and the neural network, the improved rock burst prewarning model has more reference quantity that can be used and higher accuracy in comparison of the rock burst prewarning model in Step II.

In addition to the above isothermal triaxial test with the environment temperature when rock core acquiring as the base temperature, the rock core can be divided equally into multiple samples after acquiring the rock core, and the isothermal triaxial tests can be conducted under different environment temperatures for giving different base temperatures to rock core, so as to obtain the correlation between the temperature change rate and deformation rate of the same type of rock core before rock burst at different base temperatures, which means to find that under which kind of the temperature change acceleration the rock core may produce a higher deformation acceleration further to form the rock burst, comparing and analyzing the relationship between the temperature change rate and the deformation rate before rock burst obtained by test via artificial intelligence learning in Step II, and inputting to database and rock burst prewarning model via artificial neural network algorithm, obtaining the temperature change and deformation rules of the rock core under other untested rock core base temperature, so as to approach the actual value with the increase of the artificial intelligence learning samples, which can be as a rock burst criterion in the rock burst model.

In addition, when the increased normally moves, the thermosensitive infrared sensor and the highly sensitive laser sensor receive the signals, after multiple tests under the construction condition with different temperatures and humidity, storing the experimental data in the database as a reference for signal filtering.

IV. In the tunnel excavating process, the protecting trolley is additionally equipped with a plurality of highly sensitive laser sensors used for detecting the surrounding rock deformation and thermosensitive infrared sensors used for detecting the surrounding rock temperature change, as well as an acousto-optic alarming system for alarming. The monitoring area of all thermosensitive infrared sensors comprehensively covers the surrounding rocks inside the excavating tunnel. The highly sensitive laser sensor can monitor each point in the area where rock burst may occur. In this embodiment, the protecting trolley is additionally equipped with a rotating platform, and the highly sensitive laser sensor is installed on the rotating platform. The improved rock burst prewarning model in Step III is updated in real time with the tunnel excavation and the passage of time, so as to update the prewarning results in real time. After prewarning of the rock burst on site, verifying whether the prewarning results are consistent with the actual situation on site. Taking this rock burst and the corresponding monitoring information as new sample to dynamically supplement and update the "surrounding rock mechanical parameter-rock burst critical deformation-rock burst critical temperature" database, continuously optimizing the rock burst prewarning model.

V. During tunnel excavating, the protecting trolley moves with the excavation, and the thermosensitive infrared sensor conducts monitoring, filtering the signal collected by the highly sensitive laser sensor and thermosensitive infrared sensor in the moving process of the protecting trolley via mathematic function, eliminating the peak value of the deformation curve and the data, the variation of which significantly exceeds the reference value in "surrounding rock mechanical parameter-rock burst critical deformation-rock burst critical temperature" database. When the abnormal temperature change in some area is found to approach to the reference value in the "surrounding rock mechanical parameter-rock burst critical deformation-rock burst critical temperature" database, the highly sensitive sensor turns to this area and monitors the surrounding rock deformation in this area, and the testing result is compared with the reference in the "surrounding rock mechanical parameter-rock burst critical deformation-rock burst critical temperature" database in real time. Quickly processing and comparing the threshold information of rock burst deformation or rock burst temperature in the pre-built-in "surrounding rock mechanical parameter-rock burst critical deformation-rock burst critical temperature" database by using the self-contained simple microcomputers of the thermosensitive infrared sensor and highly sensitive laser sensor, and giving a feedback. The rock burst prewarning model also receives this real time information and gives a feedback. When the data detected by either of the thermosensitive infrared sensor or highly sensitive laser sensor matches the reference data in the database, or when the rock burst prewarning model receives the data and gives a feedback of dangerous signal, the acousto-optic alarming system can give an alarm to warn the working personnel.

In addition, the thermosensitive infrared sensor with high sensibility can also be adopted to conduct a large area monitor in the rock burst prone area recorded in Step I. After obtaining the temperature abnormal point in the current area, monitoring the deformation of the abnormal point by the highly sensitive laser sensor, and obtaining the temperature change rate of the abnormal point in the current area and environment temperature, which obtains the base temperature of the rock core in the isothermal triaxial test. By comparing the "surrounding rock mechanical parameter-rock burst critical deformation-rock burst critical temperature" database and the correlation about the temperature change acceleration and deformation acceleration set in the rock burst prewarning model, i.e., comparing the threshold value of the temperature change acceleration and the threshold of the deformation acceleration before rock burst at the same time, determining the rock burst probability of the area with abnormal temperature and the intensity of the possible rock burst, and giving the possibility of rock burst in a certain area, so that the working personnel can pay more attention to those area, which facilitate the preparation of the working personnel in advance.

The above are the preferred embodiments of the present application, which are not intend to limit the protection scope of the present application. All technical solutions under the idea of the present application belong to the protection scope of the present application. It should be noted that for those skilled in the art, the improvements and refinements without departing from the principles of the present application should also be regarded as within the protection scope of the present application.

What is claimed is:

1. A protecting trolley comprising: a framework, a walking assembly, a rockfall buffering assembly, a spraying assembly, an emergency refuge assembly, an auxiliary supporting device and a rock burst prewarning system;

the walking assembly is fixed on a bottom of the framework, serving as a driving source for movement of the framework;

the rockfall buffering assembly comprises an arch frame in a fixed connection with the framework and a protecting net fixed on the arch frame, there are at least two arch frames stretching across the framework, two ends of the arch frame are disposed on two sides of the framework respectively, two sides of the protecting net are connected to two arch frames respectively, and the protecting net naturally subsides or draws close in the direction towards the framework due to self-gravity;

the protecting net comprises a receiving net, each side of the receiving net is fixed between two sides of the protecting net, the receiving net is positioned on the side of the protecting net sinking or closing to the framework, there are two impact resistant nets, which are fixedly connected on two sides of the protecting net respectively, each side of the receiving net is positioned between two sides of the corresponding impact resistant net, the receiving net and the impact resistant net are positioned on two surfaces of the protecting net respectively, and the impact resistant net and the receiving net are both abutted to the protecting net;

each side of the impact resistant net is positioned between two sides of the protecting net;

the spraying assembly comprises a track car in connection with the rockfall buffering assembly and a spraying hose fixed on the track car, and the spraying hose sprays towards the surrounding rock;

the emergency refuge assembly comprises a protecting plate fixed on the framework, an oxygen supply device fixed on the protecting plate and a fixing component fixed on the protecting plate, the protecting plate is inverted L-shaped and forms a space for accommodating personnel together with the framework, the fixing component comprises two fixing rods in a hinge joint with the protecting plate via damping hinge, and a space for a refugee head to pass through is reserved between the two fixing rods;

the auxiliary supporting device comprises a hydraulic cylinder fixed on the bottom of the framework and an abutting plate fixed on the end of the piston rod of the hydraulic cylinder, the abutting plate is disposed facing away from the framework;

the rock burst prewarning assembly comprises a thermosensitive infrared sensor used for detecting the temperature of the surrounding rock and a highly sensitive laser sensor used for detecting the deformation of the surrounding rock.

2. The protecting trolley according to claim 1, wherein the framework comprises six vertically disposed bottom vertical rods, the six bottom vertical rods are arranged symmetrically in a group of three, the bottom vertical rod is a vertically disposed I-beam, the six bottom vertical rods are distributed on two corresponding sides of a rectangle, in a group of three bottom vertical rods, the bottom vertical rods on two sides are both fixed with an inclinedly disposed bottom reinforcing rod, the bottom end of the bottom reinforcing rod is flushed with the bottom end of the bottom vertical rod, two bottom reinforcing rods on the same bottom vertical rod is arranged as a V shape with an opening downward, the I-shaped bottom vertical rod is fixedly connected with a bottom reinforcing block inside a groove in the position connected with the bottom reinforcing rod, and the bottom reinforcing block is fixed on one side of the bottom reinforcing rod;

an inclinedly disposed middle reinforcing rod is in fixed connection on a sidewall of the bottom vertical rod, a sidewall of the bottom vertical rod connected with the middle reinforcing rod is perpendicular to a sidewall thereof connected with the bottom reinforcing rod, the bottom end of the middle reinforcing rod is positioned between a top end of the bottom reinforcing rod and the bottom vertical rod, a horizontally disposed middle connecting frame is in fixed connection with the top end of the middle reinforcing rod, the middle connecting frame comprises a middle long rod connected on the top of the bottom vertical rod and a middle short rod fixed between two adjacent middle long rods.

3. The protecting trolley according to claim 2, wherein the middle connecting frame and a top connecting frame are both in a fixed connection with safety ladders, the extending directions of two safety ladders are disposed in an included angle, a top safety ladder is connected with the top connecting frame, and a bottom safety ladder is connected with the middle connecting frame, the top safety ladder and the bottom safety ladder are both connected to the protecting trolley through bolts, since the safety ladder and the protecting trolley is in a detachably bolt connection, a quantity of the safety ladder and a mounting position are changeable according to working condition;

a vertically disposed top vertical rod is fixed on a top surface of the middle connecting frame, the bottom end of the top vertical rod is fixed on the top surface of the middle long rod, the bottom ends of the top vertical rod and the connecting points of the middle connecting frame are in staggered distribution, that is, the position of the middle long rod connected with the middle short rod and the position of the middle long rod connected with the top vertical rod are in staggered distribution, a horizontally disposed top connecting frame is fixed on the top, the top connecting frame comprises a top long rod fixed with the top vertical rod and a top short rod fixed with the top vertical rod, there are six top vertical rods, which are arranged in a group of three uniformly and symmetrically on three middle long rods, there are three top long rods, and each end of the top long rod is fixed on the top end of one top vertical rod, the top vertical rod is parallel to the middle long rod, there are six top short rods, which are uniformly distributed between two gaps formed by three top long rods, the top short rod is parallel to the middle short rod and the top connecting rod is perpendicular to the top short rod, so as to form a net frame structure, a projection of the top long rod in a vertical direction is on the middle long rod, the top vertical rod and the top short rod are both I-shaped, the top vertical rod is in a fixed connection with a top connecting block inside a groove in the position connected with the top short rod, the top connecting block and the top short rod are in a fixed connection.

4. The protecting trolley according to claim 3, wherein there are three middle long rods, and each end of the middle long rod is fixed on a top of one bottom vertical rod, there are ten middle short rods, which are uniformly distributed between two gaps formed by three middle long rods, so as to form a net frame structure, the middle long rod is I-shaped, and the middle long rod is fixedly connected with a middle connecting block inside the groove in the position connected with the middle short rod, the middle connecting block is in a fixed connection with the middle short rod.

5. The protecting trolley according to claim 4, wherein in a group of three top vertical rods, the top vertical rod in the middle is fixed with an inclinedly disposed top reinforcing rod, the bottom end of the top reinforcing rod is fixed on the middle top vertical rods of the three top vertical rods in one group, and the top end is fixed on another top vertical rod besides this top vertical rod, two top reinforcing rods on the same top vertical rod is arranged as a V shape with an opening upward.

6. A construction method of rock burst prewarning protection system in non-contact tunnel construction comprising the protecting trolley according to claim 1, the method comprising following steps:

I) collecting traditional microseismic monitoring and geological prospecting data in a process of an existing tunnel excavation, determining positions with high rock burst frequency of different types of surrounding rock in different regions, and establishing a reference database;

II) taking physicochemical indexes and mechanical parameters of the surrounding rock as standard, and recording into the reference database; comparing and learning the temperature change acceleration and deformation change acceleration of surrounding rock with similar physicochemical indexes and mechanical parameters in the rock burst stage under same or similar environmental parameters via artificial intelligence learning, summarizing the rules of the temperature change and the deformation change of different surrounding rocks with same or similar physicochemical indexes in the rock burst, summarizing the rules of the temperature change and the deformation change of different surrounding rocks with same or similar mechanical parameters in the rock burst, classifying and regulating the data collected in the previous steps via artificial neural network algorithm, in addition, increasing the environment parameters such as environment temperature, environment humidity, altitude and the size of the tunnel excavating face, classifying and regulating the rules of the temperature change and deformation change of the surrounding rocks according to the surrounding rock types, environment temperatures, environment humidity, altitudes and the sizes of the tunnel excavating face respectively; after introducing the cost matrix to eliminate or weaken the adverse effects caused by the imbalance of sample categories, constructing a neural network model, training and optimizing the model, obtaining a tunnel rock burst prewarning model based on the reference database in Step I and the neural network model, inputting the multiparameter information in the area to be prewarned or the prewarning unit in the existing data into the established rock burst prewarning model, outputting the potential rock burst grade and the probability in the prewarning area via the calculation of the prewarning model;

III) obtaining the rock core in the area to be excavated via advanced geological drilling, conducting the isothermal triaxial test in the laboratory, determining the temperature change acceleration in the local temperature rapid rise stage of the surrounding rock during the rock burst foreshadow, testing and recording the temperature change acceleration when the local temperature of the surrounding rock rises during the rock burst foreshadow, inputting the above two variations into the reference data as reference; improving and forming a "surrounding rock mechanical parameter-rock burst critical deformation-rock burst critical temperature" database; comparing and analyzing each rock burst data with new variables via artificial intelligence learning in Step II, and inputting to the "surrounding rock mechanical parameter-rock burst critical deformation-rock burst critical temperature" database and the rock burst prewarning model via artificial neural network algorithm in Step II;

IV) in the tunnel excavating process, the protecting trolley is additionally equipped with a plurality of highly sensitive laser sensors used for detecting the surrounding rock deformation and thermosensitive infrared sensors used for detecting the surrounding rock temperature change, as well as an acousto-optic alarming system for alarming, the monitoring area of all thermosensitive infrared sensors comprehensively covers the surrounding rocks inside the excavating tunnel, the highly sensitive laser sensor can monitor each point in the area where rock burst may occur, the rock burst prewarning model is updated in real time with the tunnel excavation and the passage of time, so as to update the prewarning results in real time, after prewarning of the rock burst on site, verifying whether the prewarning results are consistent with the actual situation on site, taking this rock burst and the corresponding monitoring information as new sample to dynamically supplement and update the "surrounding rock mechanical parameter-rock burst critical deformation-rock burst critical temperature" database, continuously optimizing the rock burst prewarning model;

V) during tunnel excavating, the protecting trolley moves with the excavation, and the thermosensitive infrared sensor monitors the area where rock burst occurs, when the abnormal temperature change in some area is found to approach to the reference value in the "surrounding rock mechanical parameter-rock burst critical deformation-rock burst critical temperature" database, the highly sensitive sensor turns to this area and monitors the surrounding rock deformation in this area, and the testing result is compared with the reference in the "surrounding rock mechanical parameter-rock burst critical deformation-rock burst critical temperature" database in real time, quickly processing and comparing the threshold information of rock burst deformation or rock burst temperature in the pre-built-in "surrounding rock mechanical parameter-rock burst critical deformation-rock burst critical temperature" database by using the self-contained simple microcomputers of the thermosensitive infrared sensor and highly sensitive laser sensor, the rock burst prewarning model also receives this real time information and gives a feedback, when the data detected by either of the thermosensitive infrared sensor or highly sensitive laser sensor matches the reference data in the database, or when the rock burst prewarning model receives the data and gives a feedback of dangerous signal, the acousto-optic alarming system can give an alarm to warn the working personnel.

7. The construction method of rock burst prewarning protection system in non-contact tunnel construction according to claim 6, wherein the framework comprises six vertically disposed bottom vertical rods, the six bottom vertical rods are arranged symmetrically in a group of three, the bottom vertical rod is a vertically disposed I-beam, the six bottom vertical rods are distributed on two corresponding sides of a rectangle, in a group of three bottom vertical rods, the bottom vertical rods on two sides are both fixed with an inclinedly disposed bottom reinforcing rod, the bottom end of the bottom reinforcing rod is flushed with the bottom end of the bottom vertical rod, two bottom reinforcing rods on the same bottom vertical rod is arranged as a V shape with an opening downward, the I-shaped bottom vertical rod is fixedly connected with a bottom reinforcing block inside a groove in the position connected with the bottom reinforcing rod, and the bottom reinforcing block is fixed on one side of the bottom reinforcing rod;

an inclinedly disposed middle reinforcing rod is in fixed connection on a sidewall of the bottom vertical rod, a sidewall of the bottom vertical rod connected with the middle reinforcing rod is perpendicular to a sidewall thereof connected with the bottom reinforcing rod, the bottom end of the middle reinforcing rod is positioned between a top end of the bottom reinforcing rod and the bottom vertical rod, a horizontally disposed middle connecting frame is in fixed connection with the top end of the middle reinforcing rod, the middle connecting frame comprises a middle long rod connected on the top of the bottom vertical rod and a middle short rod fixed between two adjacent middle long rods.

8. The construction method of rock burst prewarning protection system in non-contact tunnel construction according to claim 7, wherein the middle connecting frame and a top connecting frame are both in a fixed connection with safety ladders, the extending directions of two safety ladders are disposed in an included angle, a top safety ladder is connected with the top connecting frame, and a bottom safety ladder is connected with the middle connecting frame, the top safety ladder and the bottom safety ladder are both connected to the protecting trolley through bolts, since the safety ladder and the protecting trolley is in a detachably bolt connection, a quantity of the safety ladder and a mounting position are changeable according to working condition;

a vertically disposed top vertical rod is fixed on a top surface of the middle connecting frame, the bottom end of the top vertical rod is fixed on the top surface of the middle long rod, the bottom ends of the top vertical rod and the connecting points of the middle connecting frame are in staggered distribution, that is, the position of the middle long rod connected with the middle short rod and the position of the middle long rod connected with the top vertical rod are in staggered distribution, a horizontally disposed top connecting frame is fixed on the top, the top connecting frame comprises a top long rod fixed with the top vertical rod and a top short rod fixed with the top vertical rod, there are six top vertical rods, which are arranged in a group of three uniformly and symmetrically on three middle long rods, there are three top long rods, and each end of the top long rod is fixed on the top end of one top vertical rod, the top vertical rod is parallel to the middle long rod, there are six top short rods, which are uniformly distributed between two gaps formed by three top long rods, the top short rod is parallel to the middle short rod and the top connecting rod is perpendicular to the top short rod, so as to form a net frame structure, a projection of the top long rod in a vertical direction is on the middle long rod, the top vertical rod and the top short rod are both I-shaped, the top vertical rod is in a fixed connection with a top connecting block inside a groove in the position connected with the top short rod, the top connecting block and the top short rod are in a fixed connection.

9. The construction method of rock burst prewarning protection system in non-contact tunnel construction according to claim 8, wherein there are three middle long rods, and each end of the middle long rod is fixed on a top of one bottom vertical rod, there are ten middle short rods, which are uniformly distributed between two gaps formed by three middle long rods, so as to form a net frame structure, the middle long rod is I-shaped, and the middle long rod is fixedly connected with a middle connecting block inside the groove in the position connected with the middle short rod, the middle connecting block is in a fixed connection with the middle short rod.

10. The construction method of rock burst prewarning protection system in non-contact tunnel construction according to claim 9, wherein in a group of three top vertical rods, the top vertical rod in the middle is fixed with an inclinedly disposed top reinforcing rod, the bottom end of the top reinforcing rod is fixed on the middle top vertical rods of the three top vertical rods in one group, and the top end is fixed on another top vertical rod besides this top vertical rod, two top reinforcing rods on the same top vertical rod is arranged as a V shape with an opening upward.

11. The construction method of rock burst prewarning protection system in non-contact tunnel construction according to claim 6, wherein in Step III, the rock core is divided equally into multiple samples after acquiring the rock core, and the isothermal triaxial tests is conducted under different environment temperatures for giving different base temperatures to rock core, so as to obtain the correlation between the temperature change rate and deformation rate of the same type of rock core before rock burst at different base temperatures, which means to find that under which kind of the temperature change acceleration the rock core produces a higher deformation acceleration further to form the rock burst, taking this correlation as a rock burst criterion in the "surrounding rock mechanical parameter-rock burst critical deformation-rock burst critical temperature" database and the rock burst prewarning model.

12. The construction method of rock burst prewarning protection system in non-contact tunnel construction according to claim 6, wherein in Step III, comparing and analyzing the relationship between the temperature change rate and the deformation rate before rock burst obtained by test via artificial intelligence learning in Step II, and inputting to the "surrounding rock mechanical parameter-rock burst critical deformation-rock burst critical temperature" database and rock burst prewarning model via artificial neural network algorithm, obtaining the temperature change and deformation rules of the rock core under other untested rock core base temperature, so as to approach the actual value with the increase of the artificial intelligence learning samples, which is as a rock burst criterion in the rock burst model.

13. The construction method of rock burst prewarning protection system in non-contact tunnel construction according to claim 6, wherein in Step III, when the increased normally moves, the thermosensitive infrared sensor and the highly sensitive laser sensor receive the signals, after multiple tests under different construction condition, storing the experimental data in the "surrounding rock mechanical parameter-rock burst critical deformation-rock burst critical temperature" database as a reference for signal filtering, filtering the signal collected by the highly sensitive laser sensor and thermosensitive infrared sensor in the moving process of the protecting trolley via mathematic function, eliminating the peak value of the deformation curve and the data, the variation of which significantly exceeds the reference value in "surrounding rock mechanical parameter-rock burst critical deformation-rock burst critical temperature" database.

14. The construction method of rock burst prewarning protection system in non-contact tunnel construction according to claim 6, wherein the neural network in Step III comprises 1 input layer, 2 convolutional layers, 2 pooling layers, 2 full-connected layers, 1 Softmax layer and 1 decision layer; the input layer inputs multi parameter sequence, the decision layer outputs the rock burst grade and probability thereof; training and optimizing the constructed neural network model using the reference data in Step I, obtaining the model parameters with the highest classification accuracy of rock burst grade according to the classification results of test samples, that is, obtaining the rock burst prewarning model based on the "surrounding rock mechanical parameter-rock burst critical deformation-rock burst critical temperature" database and the neural network.

* * * * *